United States Patent [19]

Nakao et al.

[11] 4,136,344

[45] Jan. 23, 1979

[54] MINIATURE RECEIVING SET WITH A PIVOTABLE STAND

[75] Inventors: Toshihiro Nakao; Kazumi Saito, both of Hachioji, Japan

[73] Assignee: Olympus Optical Co., Ltd., Tokyo, Japan

[21] Appl. No.: 810,919

[22] Filed: Jun. 29, 1977

[30] Foreign Application Priority Data

Jul. 22, 1976 [JP] Japan ..... 51-97876[U]

[51] Int. Cl.[2] ..... H01Q 1/12

[52] U.S. Cl. ..... 343/702; 343/901; 325/310; 325/354

[58] Field of Search ..... 343/702, 901-903; D14/86, 87, 68, 72; 325/310, 354

[56] References Cited

U.S. PATENT DOCUMENTS

| | | | |
|---|---|---|---|
| 2,388,567 | 11/1945 | Patterson, Jr. | 343/702 |
| 2,531,215 | 11/1950 | Harmon | 343/702 |

*Primary Examiner*—Alfred E. Smith
*Assistant Examiner*—David K. Moore

[57] ABSTRACT

A portable radio provided with an antenna case for a telescopic rod antenna includes a stand pivotally connected to the antenna case so as to be capable of swinging thereround to a working position in which the radio is leaned on a table by the stand.

11 Claims, 6 Drawing Figures

MINIATURE RECEIVING SET WITH A PIVOTABLE STAND

BACKGROUND OF THE INVENTION

This invention relates to a miniature receiving set, more specifically to a receiving set with an antenna case for containing a telescopic rod antenna.

Since a miniature receiving set, such as portable radio, is usually so constructed that the sounds from its built-in speaker may be emitted through both front and back faces thereof, it should, in use, preferably be held in hand or put on a table with the side face downward so as not to obstruct the sounding portions in the front and back faces. In general, however, this type of receiving set is thin and has various adjusting dials or knobs arranged on its side face, so that it is difficult to put it on a table in such a manner as described above. Therefore, it has conventionally been held in hand in use.

SUMMARY OF THE INVENTION

An object of this invention is to provide a receiving set capable of being set securely in a fixed place without marring the appearance or enlarging the size thereof.

At first, the inventors thought of leaning a miniature receiving set against a stand or support swingably attached to the back of the casing of such receiving set. In doing this, however, if the stand is pivotally mounted on the outside of the casing, the pivotal portion will protrude outward to mar the appearance of the set. Meanwhile, if the stand is mounted on the inside of the casing to eliminate such fault, then the casing will have to be enlarged in size correspondingly to the added pivotal portion, presenting an alternative fault. In either case, it would be necessary to fix a fully tough pivot to the casing, thus requiring more complicated construction as well as increased weight.

This invention, contrived in consideration of the above circumstances, can provide a miniature receiving set cleared of the aforesaid difficulties by pivotally attaching one end of the stand to the outer periphery of an antenna case fixed to the casing.

BRIEF DESCRIPTION OF THE DRAWINGS

FIG. 3 is a cross section of the same radio with the rod antenna drawn in;

DETAILED DESCRIPTION OF THE PREFERRED EMBODIMENT

Now I will describe the portable radio as an embodiment of the miniature receiving set according to the invention.

Figure 1:
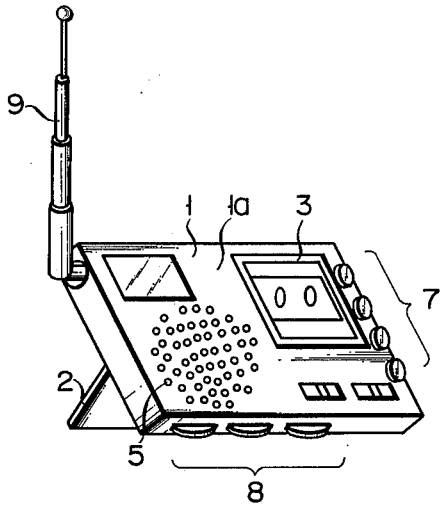
FIG. 1 is a front perspective view of the portable radio according to an embodiment of this invention.
Figure 2:
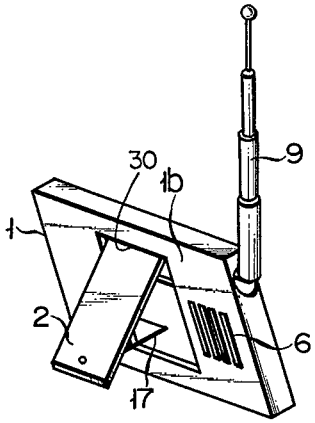
FIG. 2 is a rear perspective view of the same portable radio.

Referring now to FIGS. 1 and 2, the radio placed on a table (not shown) is leaned against a stand 2 pivotally supported within a casing 1 by a suitable means as mentioned hereinafter, the stand 2 being opened on the back side of the casing 1. The casing 1 is a flat plastic box having a front wall 1*a* provided with a cassette loading portion 3 and a number of pores 5 through which sounds from a built-in speaker 4 (FIGS. 3 and 4) are emitted outward. Meanwhile, in the back wall 1*b*, at a position opposite to the pores 5, are formed a number of slits 6 through which the sounds from the speaker are emitted. The front wall 1*a* is further provided with various adjusting dials or knobs 7 for a tape recorder, while the bottom wall is provided with a series of adjusting or control dials 8 for a radio in such manner as in the prior art, respectively. In FIGS. 1 and 2, a telescopic rod antenna designated by numeral 9 is extended from the casing 1 or in a working position.

Figure 3:
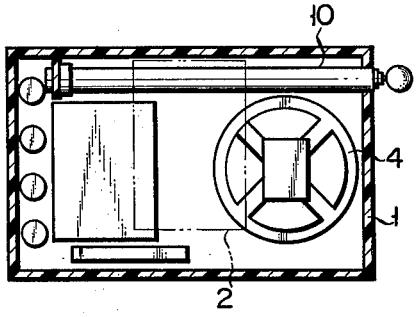
Figure 4:
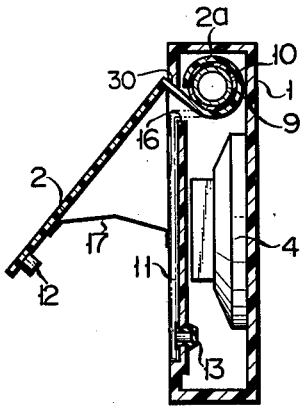
FIG. 4 is a vertical section of the same radio.

Referring now to FIGS. 3 and 4, within the casing 1 is provided an antenna case or holder 10 having one end supported by a projection on the casing 1 and extending substantially in parallel with the longitudinal direction of the casing along the top face thereof. The antenna case 10 is so constructed as to contain the rod antenna 9 in the known manner.

In the back wall 1*b* of the casing near the antenna case 10 is provided an elongated opening 16 extending along the tubular case 10, while the outer face portion of the back wall 1*b* below the opening 16 is somewhat rectangularly recessed to form a receptacle 11 for the stand 2.

Figure 5:
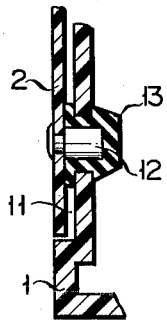
FIG. 5 is an enlarged sectional view of the stopper pin socket of the same radio.

The stand 2 is a plate having one end provided with a cylindrical pivotal portion 2*a* for mounting the stand 2 pivotally on the antenna case 10 by loosely enclosing the case 10 as shown in FIG. 4. The other end of the stand 2 extends to the outside of the casing 1 through the opening 16 in the back wall 1*b*, and a stopper pin 12 protrudes from the side of the extended end facing the recessed receptacle 11. Meanwhile, at the bottom of the recessed receptacle 11, correspondingly to the stopper pin 11, is provided a rubber pin socket or barrel 13 to tightly receive the pin 12. Thus, when the stand is not in use in carrying the radio body, it may be fitted in the recessed receptacle 11, where the outer face of the stand 2 is substantially flush with the outer face of the back wall 16 of the casing. Such position may be retained by inserting the stopper pin 12 tightly into the pin socket 13 as shown in FIG. 5. On the other hand, when in use, the stand 2 may be swung clockwise as in FIG. 4 round the pivotal portion 2*a*, thereby separating the bottom end of the stand 2 from the casing 1. The maximum opened position of the stand 2 may be retained by bringing the top portion of the stand 2 into contact with the upper 30 of the opening 16, while in this embodiment, such retention may be ensured further securely by a tape 17 with both ends connected to the stand 2 and the back wall 1*b* of the casing, respectively. The tape 17 may be made of cloth, vinyl or paper, which should preferably be of relatively high rigidity and be able to be bent and folded up on the center thereof for the better settlement of the stand 2.

Figure 6:
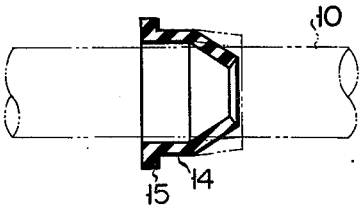
FIG. 6 is an enlarged sectional view of a component of an alternative embodiment of the radio of this invention.

As for the material for the stand 2, it may be any rigid substance with a certain measure of strength, including metal, plastic, etc. In using an electric conducting material, however, if the antenna case 10 is conductive, it is expressly desirable to insulate the stand 2 electrically from the antenna case 10 by interposing an insulator between the pivotal portion of the stand 2 and the case 10 as shown in FIG. 6. The insulator as shown in FIG. 6 is composed of two plastic tubes 14 (one alone shown) with one end provided with a flange 15 and the other end tapered. These two tubes 14 are put on the outer periphery of the antenna case 10 with their respective flange portions directed outward, and may be brought into close contact with such periphery of the case 10 by widening the tapered portion outward with the case 10. The stand 2 may be insulated securely from the case 10 and the longitudinal movement of the case 10 may be controlled properly by interposing the stand 2 between the flanges 15 of the plastic tubes 14 so that such flanges 15 may be pressed against both ends of the pivotal portion.

What we claim is:

1. A miniature receiving set comprising a casing with a back wall having an opening, an antenna case provided within said casing, a telescopic rod antenna contained within said antenna case so as to be allowed to extend outward from said casing, a stand having one end provided with a pivotal portion pivotally supported by said antenna case and the other end extending outward from said back wall of said casing through said opening, said stand being capable of swinging round said antenna case to a working position where the other end thereof is kept away from said casing, and a retaining means provided between said casing and said stand to fix said stand in said working position.

2. A miniature receiving set according to claim 1 wherein said pivotal portion of said stand is a cylindrical portion loosely enclosing the outer periphery of said antenna case.

3. A miniature receiving set according to claim 2 wherein said pivotal portion of said stand is composed of an electric insulating material.

4. A miniature receiving set according to claim 2 wherein said antenna case and said pivotal portion of said stand are composed of an electric conductor, and an electric insulating member is interposed between said case and said pivotal portion.

5. A miniature receiving set according to claim 2 wherein said opening in the back wall of said casing is an elongated opening extending along said antenna case in the vicinity thereof, and said stand has a plate portion extending from said opening.

6. A miniature receiving set according to claim 5 wherein the back wall of said casing includes on the outside thereof a recess comprising a receptacle for containing said stand.

7. A miniature receiving set according to claim 6 further comprising a means for retaining said stand contained within said recess.

8. A miniature receiving set according to claim 5 wherein said retaining means includes a contact portion on said casing to come in contact with said stand in the working position thereof.

9. A miniature receiving set according to claim 8 wherein said contact portion is a part of the back wall defining an upper edge of said opening.

10. A miniature receiving set according to claim 1 wherein said retaining means comprises a cord having both ends connected to said stand and the back wall of said casing, respectively, and stretched therebetween in the working position of said stand.

11. A miniature receiving set according to claim 10 wherein said cord is a tape capable of being folded up in the middle.

* * * * *